US009410550B2

(12) United States Patent
Yeh et al.

(10) Patent No.: US 9,410,550 B2
(45) Date of Patent: Aug. 9, 2016

(54) AIR-EXTRACTING TYPE HEAT DISSIPATING APPARATUS

(75) Inventors: Shir-Harn Yeh, Taoyuan Hsien (TW); Yi-Ming Wu, Taoyuan Hsien (TW); Po-Hao Yu, Taoyuan Hsien (TW)

(73) Assignee: DELTA ELECTRONICS, INC., Taoyuan Hsien (TW)

( * ) Notice: Subject to any disclaimer, the term of this patent is extended or adjusted under 35 U.S.C. 154(b) by 738 days.

(21) Appl. No.: 13/620,367

(22) Filed: Sep. 14, 2012

(65) Prior Publication Data

US 2013/0149122 A1 Jun. 13, 2013

(30) Foreign Application Priority Data

Dec. 7, 2011 (TW) ..... 100145167 A

(51) Int. Cl.
*F04D 19/00* (2006.01)
*F04D 25/06* (2006.01)
*F04D 29/58* (2006.01)

(52) U.S. Cl.
CPC ..... *F04D 25/0613* (2013.01); *F04D 19/002* (2013.01); *F04D 25/068* (2013.01); *F04D 29/5813* (2013.01)

(58) Field of Classification Search
CPC ..... F04D 25/0613; F04D 25/068; F04D 29/5813; F04D 19/002
See application file for complete search history.

(56) References Cited

U.S. PATENT DOCUMENTS

| | | | | |
|---|---|---|---|---|
| 4,628,992 | A * | 12/1986 | Kennedy | 165/123 |
| 5,393,197 | A | 2/1995 | Lemont et al. | |
| 6,253,834 | B1 * | 7/2001 | Sterner | 165/80.3 |
| 7,028,753 | B2 * | 4/2006 | Sterner | 165/80.3 |
| 2005/0106046 | A1 | 5/2005 | Winkler | |
| 2008/0124234 | A1 * | 5/2008 | Echazarreta | 417/423.14 |
| 2008/0279694 | A1 * | 11/2008 | Chou et al. | 416/244 R |
| 2011/0135520 | A1 | 6/2011 | Pal | |
| 2012/0163973 | A1 * | 6/2012 | Yu | 415/227 |
| 2012/0234520 | A1 * | 9/2012 | Pal et al. | 165/121 |
| 2012/0243177 | A1 * | 9/2012 | Pal | 361/695 |

* cited by examiner

*Primary Examiner* — Ninh H Nguyen
*Assistant Examiner* — Jesse Prager
(74) *Attorney, Agent, or Firm* — Muncy, Geissler, Olds & Lowe, P.C.

(57) ABSTRACT

An air-extracting type heat dissipating apparatus includes a frame, a fan body, a plurality of air-inhaling holes and a plurality of air-exhaling holes. The side portion of the frame has an accommodating space. The fan body is disposed in the frame and has a first side and a second side. The air-inhaling holes are disposed on the side portion of the frame in corresponding to the accommodating space. The air-exhaling holes are disposed on the frame and located on the second side. An air is inhaled into the accommodating space through the air-inhaling holes, and exhaled to the first side through the air-exhaling holes, and then it is exhaled to the second side by the fan body.

14 Claims, 11 Drawing Sheets

AIR-EXTRACTING TYPE HEAT DISSIPATING APPARATUS

CROSS REFERENCE TO RELATED APPLICATIONS

This Non-provisional application claims priority under 35 U.S.C. §119(a) on Patent Application No(s). 100145167 filed in Taiwan, Republic of China on Dec. 7, 2011, the entire contents of which are hereby incorporated by reference.

BACKGROUND OF THE INVENTION

1. Field of Invention

The present invention relates a heat dissipating apparatus, and in particular, to an air-extracting type heat dissipating apparatus.

2. Related Art

Because the performance of the electronic device is continuously promoted, it causes that the heat is increasingly produced when the electronic device runs. Hence, the efficiency of the heat dissipating apparatus is expected to be improved. Conventionally, the air-extracting type heat dissipating apparatus of fans is commonly used. However, the efficiency of heat dissipation of single fan is poor due to its low inhaled air volume.

Therefore, in order to improve the heat-dissipating efficiency, the conventional air-extracting type heat-dissipating apparatuses 1*a* and 1*b* as shown in FIG. 1A and FIG. 1B individually have two fan bodies 11 connected in series and in parallel, respectively, and they have power supply apparatuses 12*a* and 12*b* respectively for driving the fan bodies 11 of the air-extracting type heat-dissipating apparatuses 1*a* and 1*b*. However, the space to dispose two of the fan bodies 11 is great, and the power supply apparatus 12*a* and 12*b* also have the requirement of dissipating the heat generated by themselves. But, disposing extra heat dissipating for the power supply apparatus 12*a* and 12*b* not only is restricted by the insufficient interior space but also increases the production cost.

Besides, as shown in FIG. 2, another conventional air-extracting type heat-dissipating apparatus 2 has a fan body 21 and a power supply apparatus 22, and openings 211 are disposed on the positive pressure side (air-exhausting side) of the casing of the fan body 21. Such that, the exhausted air can be diverted through the openings 211 on the casing of the fan body 21 so as to dissipate the heat source of the power supply apparatus and electronic device. However, diversion of the air results in not only reducing the heat dissipating efficiency of the air-extracting type heat dissipating apparatus 2 of the electronic device, but also increasing the noise level as the air-extracting type heat-dissipating apparatus 2 runs.

Hence, it has been an important issue to provide an air-extracting type heat dissipating apparatus capable of increasing the heat dissipating efficiency instead of increasing the noise level.

SUMMARY OF THE INVENTION

In view of the foregoing, the purpose of the present invention is to provide an air-extracting type heat-dissipating apparatus capable of increasing the heat dissipating efficiency instead of increasing the noise level.

To achieve the purpose as described above, an air-extracting type heat-dissipating apparatus in accordance with the present invention includes a frame, a fan body, a plurality of air-inhaling holes and a plurality of air-exhaling holes. The side portion of the frame has an accommodating space. The fan body is disposed in the frame and has a first side and a second side. The air-inhaling holes are disposed on the side portion of the frame in corresponding to the accommodating space. The air-exhaling holes are disposed on the frame and located on the second side. An air is inhaled into the accommodating space through the air-inhaling holes, and exhaled to the first side through the air-exhaling holes, and then it is exhaled to the second side by the fan body.

In one embodiment of the present invention, the heat source is disposed in the accommodating space.

In one embodiment of the present invention, the frame has a casing disposed on the side portion of the frame to define the accommodating space. The air-inhaling holes are disposed on the casing and the air-inhaling holes are slit-shaped.

In one embodiment of the present invention, the frame further has an extended channel structure located at the first side, and the air-exhaling holes are disposed at the extended channel structure.

In one embodiment of the present invention, when the air-extracting type heat dissipating apparatus disposes horizontally and the second side is as the bottom, the height of the air-exhaling holes is greater than the height of the fan body.

In one embodiment of the present invention, the air-exhaling holes are arranged in sequence with increasing sizes from the first side to the second side.

In one embodiment of the present invention, the casing comprises a base and two side walls extending opposite from the base. The air-inhaling holes are disposed on the base or side wall. The air-inhaling hole has a round or rectangular shape.

In summary, because a plurality of air-inhaling holes are disposed on the side portion of the frame configured with the accommodating space in the air-extracting type heat-dissipating apparatus of the present invention, and the air-exhaling holes are disposed on the frame and located on the first side (for example, the negative pressure side or air-inhaling side). Therefore, air flow enters the accommodating space from the air-inhaling holes by convection when the fan body runs, such that the heat source (such as the circuit board of the power supply apparatus) positioned in the accommodating space can be dissipated. Further, when the fan body runs, the pressure difference is formed between the first side and the second side (for example positive pressure side or air-exhaling side) and results in forming convection, and the air in the accommodating space is exhaled to the first side through the air-exhaling holes, and exhaled to the second side by the fan body, thereby further dissipating the heat generated by other electronic devices.

Hence, the air-extracting type heat dissipating apparatus in accordance with the present invention can dissipate the heat source inside by increasing the inhaled air volume through the air-inhaling holes disposed on the side of the frame, instead of diverting the inhaled air, such that the efficiency of heat dissipation is effectively improved.

Besides, because the openings in convention are disposed on the exhaling side of the apparatus to divert the air, it results in the problem of increasing noise level. However, since the air-exhaling holes of the present invention are disposed on the first side (air-inhaling side) and are not used to divert the air, it can not cause the problem.

BRIEF DESCRIPTION OF THE DRAWINGS

The present invention will be apparent from the following detailed description, which proceeds with reference to the accompanying drawings, wherein the same references relate to the same elements.

Figure 1A:
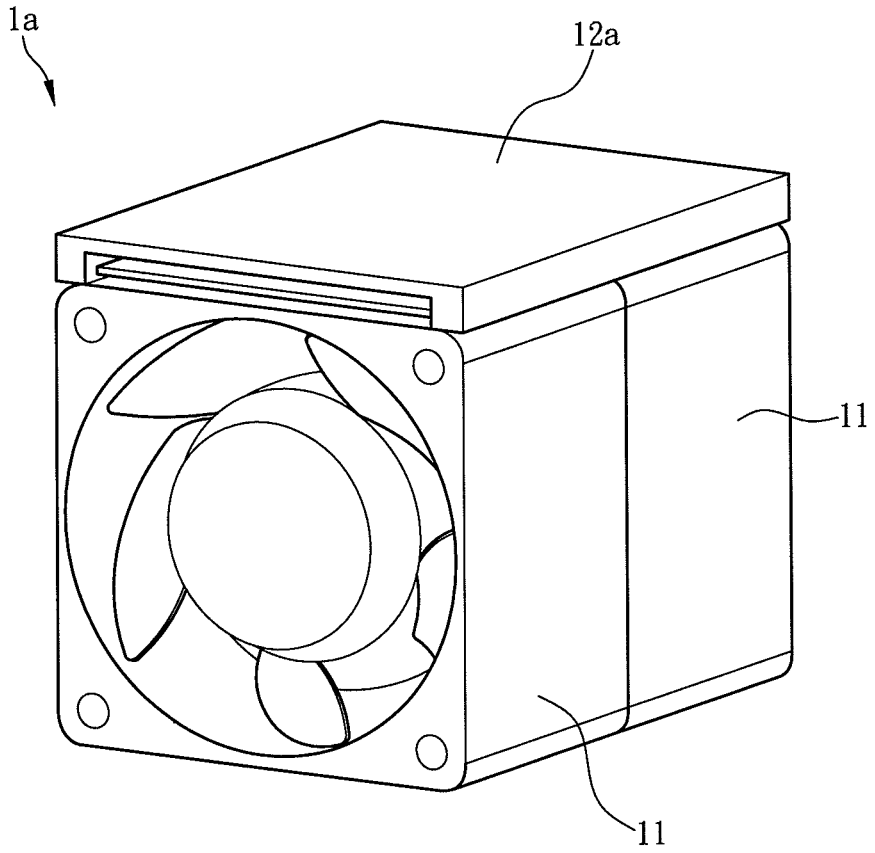
FIG. 1A (Prior Art)
FIG. 1A and FIG. 1B are schematic figures illustrating the appearance conventional air-extracting type heat dissipating apparatus.
Figure 1B:
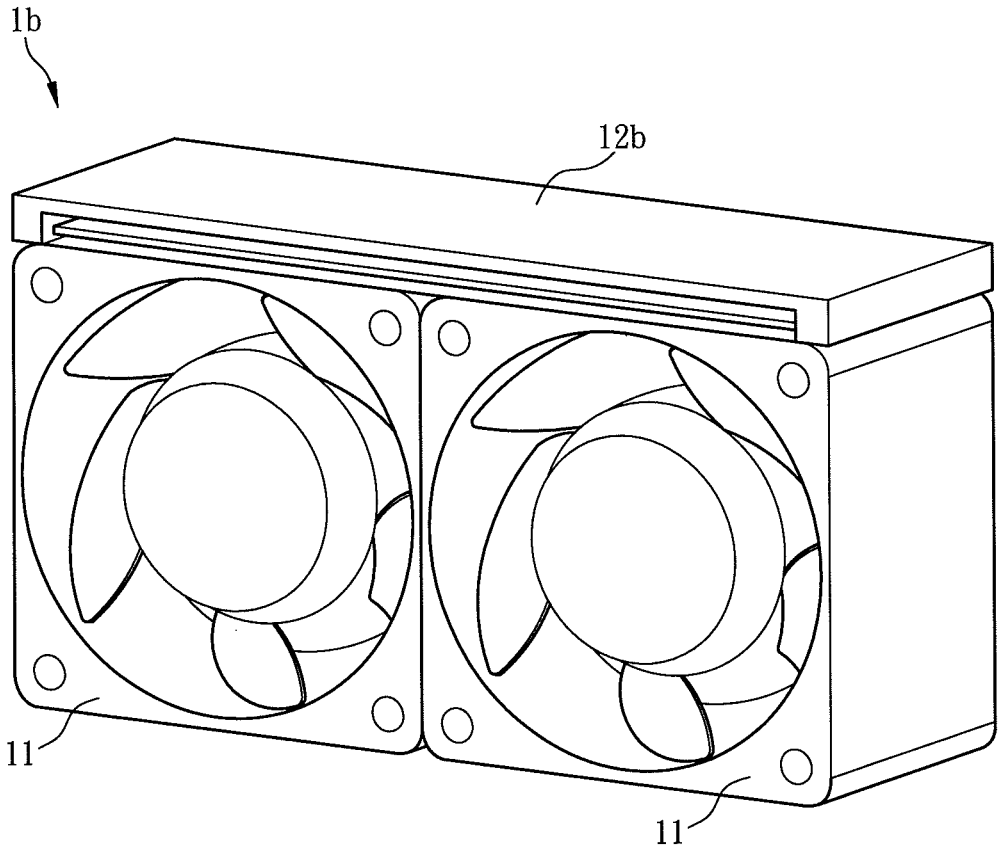
FIG. 1B (Prior Art)
Figure 2:
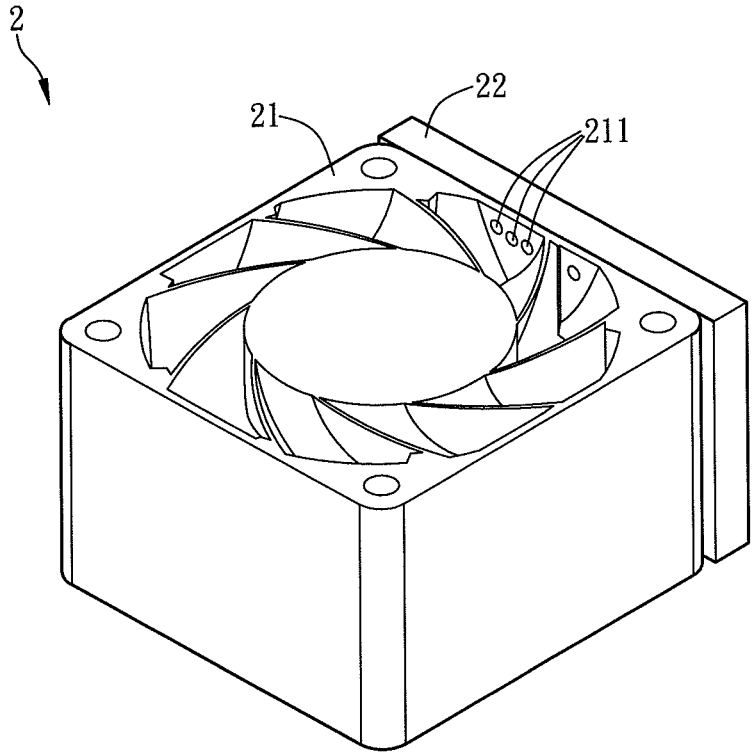
FIG. 2 (Prior Art)
FIG. 2 is a schematic figure illustrating the appearance of another conventional air-extracting type heat-dissipating apparatus.
Figure 3A:
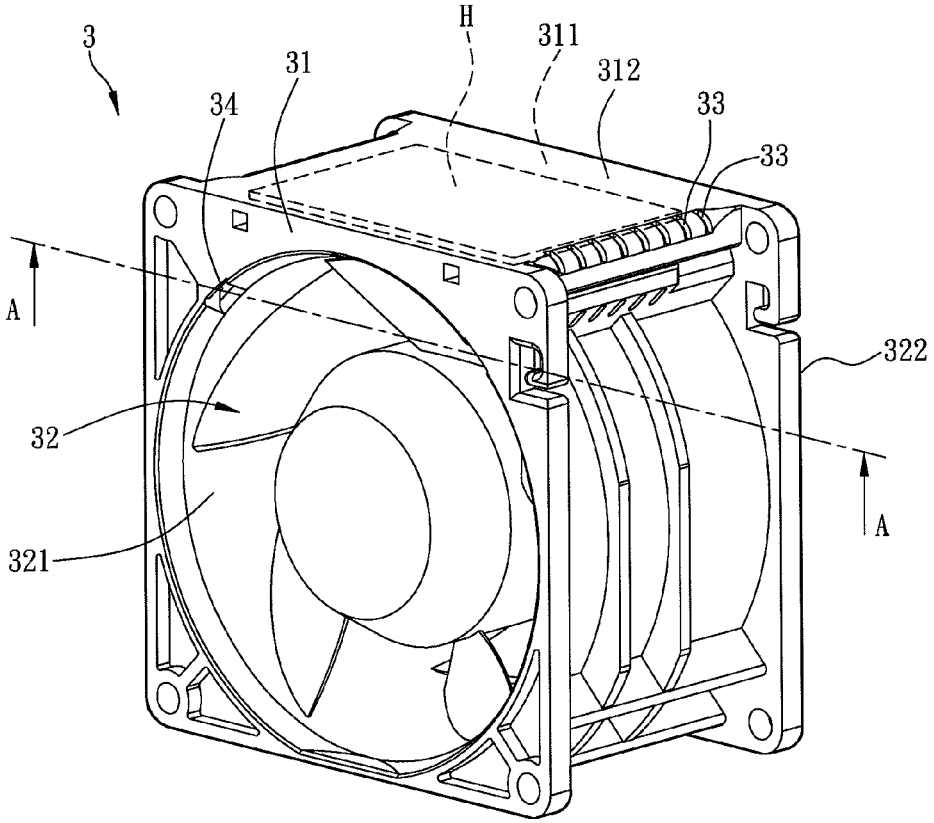
FIG. 3A is a schematic figure illustrating the appearance of an air-extracting type heat dissipating apparatus in accordance with a preferred embodiment of the present invention.

FIG. 3A shows an air-extracting type heat-dissipating apparatus 3 according to a preferable embodiment of the present invention. The air-extracting type heat-dissipating apparatus 3 includes a frame 31, a fan body 32, a plurality of the air-inhaling holes 33 and a plurality of the air-exhaling holes 34.

The shape of the frame 31 is not limited and one side of the frame 31 has an accommodating space 311. A heat source H is positioned the inside of the accommodating space 311, and it can be for example but not limited to a circuit board of the power supply apparatus.

The fan body 32 is disposed in the frame 31, and has a first side 321 and a second side 322. The first side 321 is, for example, a negative pressure side or an air-inhaling side and the second side 322 is, for example, a positive pressure side or an air-exhaling side.

The air-inhaling holes 33 are disposed on the side portion of the frame 31 in corresponding to the accommodating space 311. In this embodiment, the air-inhaling holes 33 are slit-shaped and can be respectively disposed on the upper and lower parts of both sides of the accommodating space 311 (only one side shown in FIG. 3A). The air-inhaling holes 33 can be also for example but not limited to non-slit-shaped, or disposed on one side of the accommodating space 311, or just disposed on the upper part or the lower part of both sides of the accommodating space 311 if necessary. However, the configuration of the air-inhaling holes 33 should be still considered to increase the inhaled air volume and the efficiency of the inhaled air in priority.

Figure 3B:
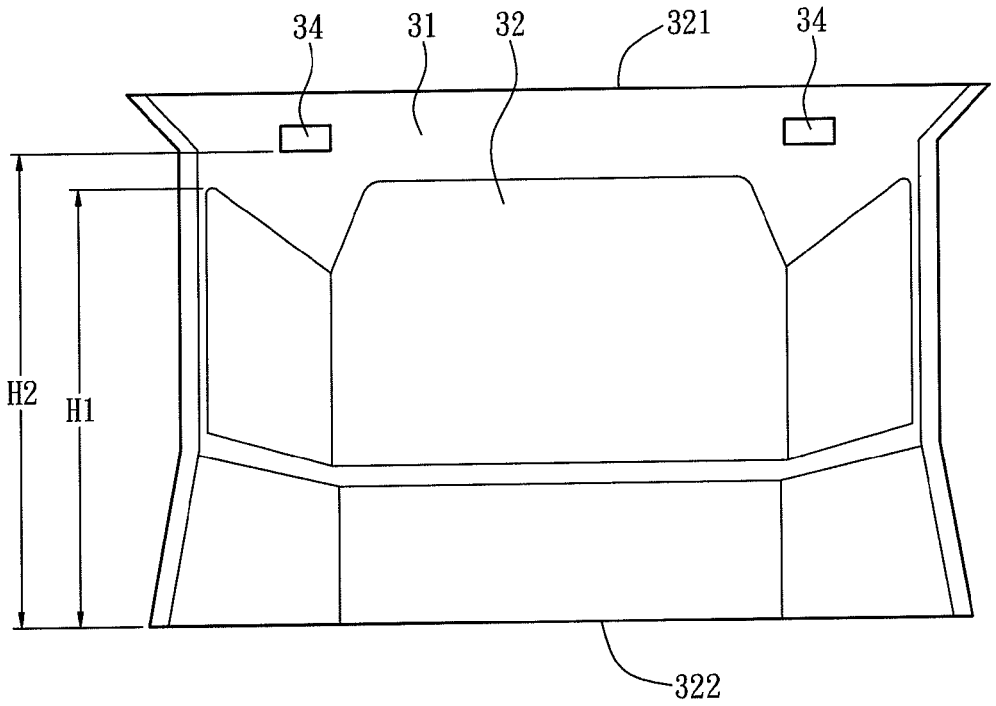
FIG. 3B is a laterally cross-sectional figure of the air-extracting type heat-dissipating apparatus along section line A-A in accordance with a preferred embodiment of the present invention.

The air-exhaling holes 34 are disposed on the frame 31 and located on the first side 321. In this embodiment, an example of the air-exhaling holes 34 illustrated herein is two air-exhaling holes 34. In addition, FIG. 3B shows the cross-sectional view of the air-extracting type heat dissipating apparatus 3 along section line A-A. As shown in FIG. 3B, when the air-extracting type heat dissipating apparatus 3 is disposed horizontally and the second side 322 is as the bottom, the height H2 of the air-exhaling holes 34 is greater than the height H1 of the fan body 32. Therefore, when the air in the accommodating space 311 is exhaled to the first side 321, it can be successfully exhaled to the second side 322 by the fan body 32.

Hence, when the fan body 32 runs, the air enters the accommodating space 311 through the air-inhaling holes 33 caused by convection, so as to dissipate the heat source H (such as a circuit board of the electronic device) positioned in the accommodating space 311. Besides, when the fan body 32 runs, the pressure difference is formed between the first side 321 and the second side 322 (for example positive pressure side or air-exhaling side) and results in forming convection, so that the air in the accommodating space 311 is exhaled to the first side 321 through the air-exhaling holes 34, and exhaled to the second side 322 by the fan body 32, thereby further dissipating the heat generated by other electronic devices.

Hence, the air-extracting type heat-dissipating apparatus 3 of the present embodiment can dissipate the heat source H inside due to increasing the inhaled air volume by means of disposing the air-inhaling holes 33 disposed on the side portion of the frame 31 and instead of diverting the inhaling air, such that the efficiency of heat dissipation is effectively improved. Besides, the openings in convention are disposed on the exhaling side of the apparatus to divert the air and results in the problem of increasing noise level. However, since the air-exhaling holes 34 of the present invention are disposed on the first side 321 (air-inhaling side) and are not used to divert the air, they can not cause the problem.

Figure 4:
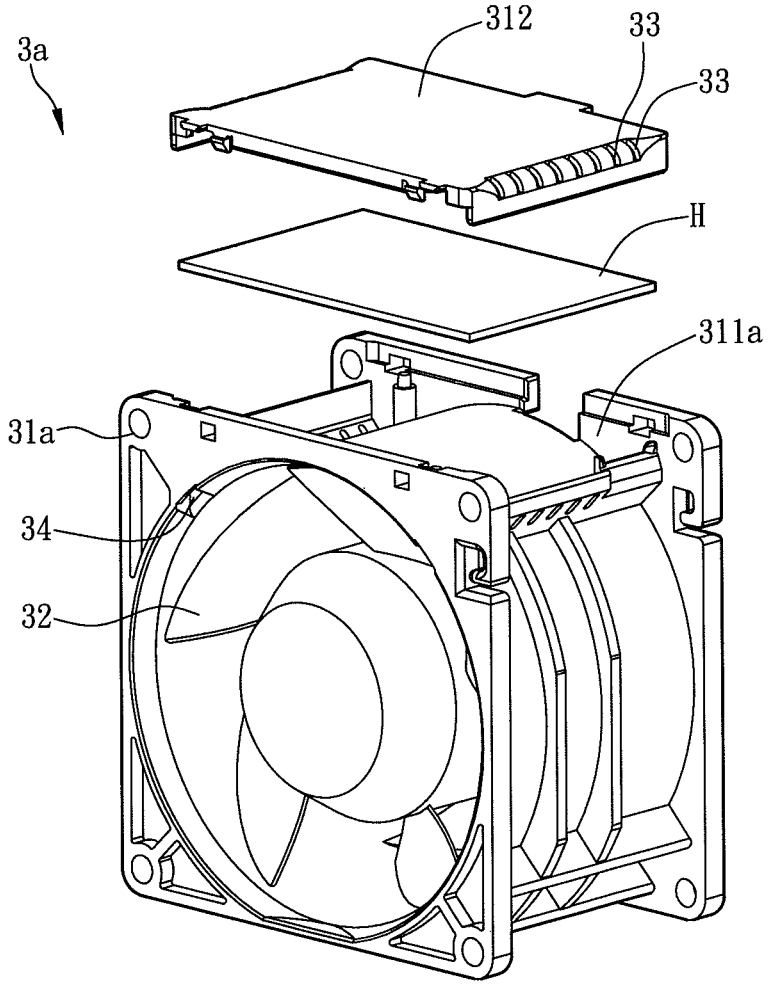
FIG. 4 to FIG. 9 are schematic figures illustrating the appearance of the air-extracting type heat-dissipating apparatus in accordance with different aspects of the present invention.

FIG. 4 shows an air-extracting type heat dissipating apparatus 3*a* of another aspect of the present invention. The difference between the air-extracting type heat-dissipating apparatus 3*a* and the air-extracting type heat dissipating apparatus 3 is that the frame 31*a* has a casing 312 disposed on the side portion of the frame 31*a* to configure the accommodating space 311*a*. The air-inhaling holes 33 are disposed on the casing 312 and the air-inhaling holes 33 are similarly for example but not limited to slit-shaped.

The casing 312 can be combined with the frame 31*a* by wedging, sticking, buttoning, or embedding to configure an accommodating space 311*a*. In this embodiment, the casing 312 can be combined with the frame 31*a* by buttoning to configure an accommodating space 311*a*. In addition, the inner side of the casing 312 faced the accommodating space 311*a* can be also, for example but not limited to, configured with a conducting structure to improve the efficiency of heat dissipation.

Figure 5:
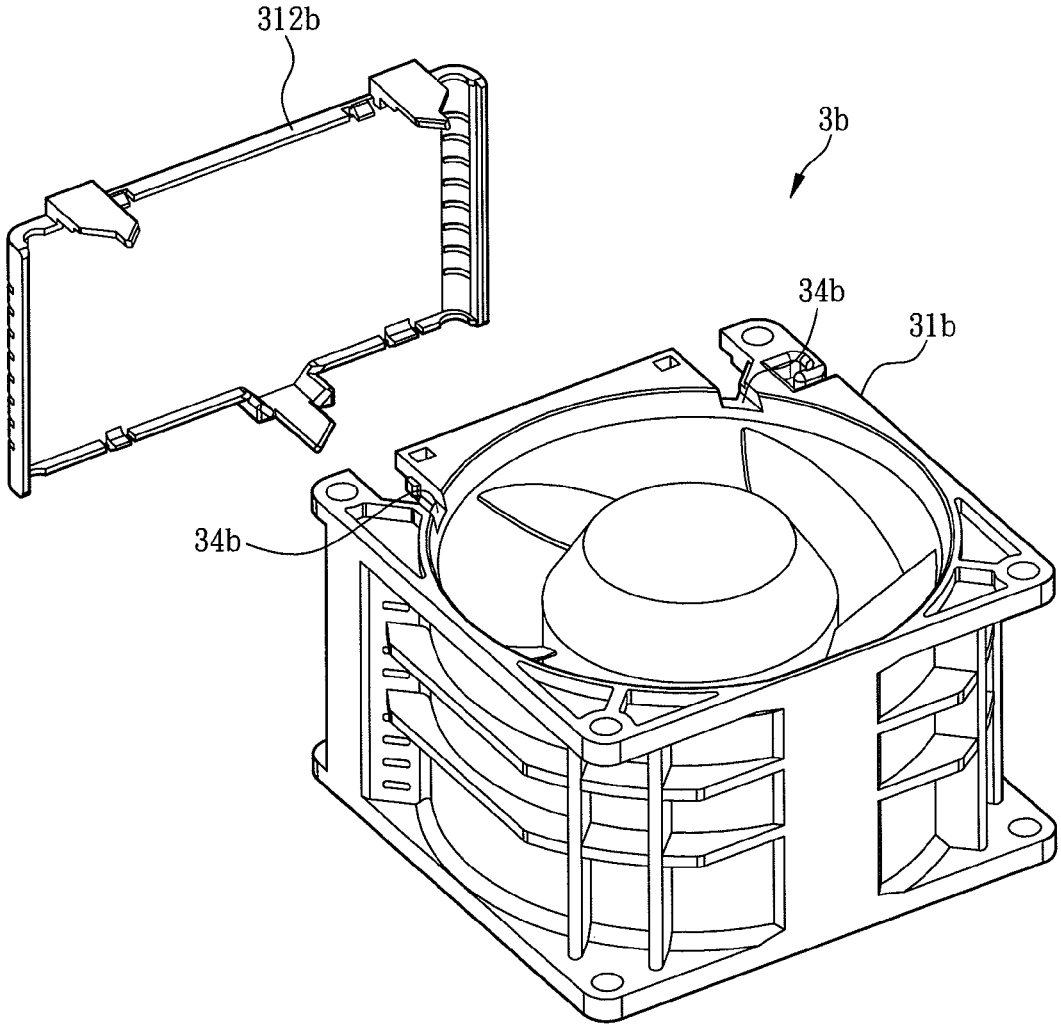

Moreover, FIG. 5 shows an air-extracting type heat dissipating apparatus 3*b* of an aspect of the present invention. Depending on the types of the casing 312*b*, the air-exhaling holes can be configured for example but not limited to by incorporating the casing 312*b* with the frame 31*b*. However, the casing 312*b* can be other types in accordance with requirements.

Thus, as shown in FIG. 4, the air-exhaling holes 33 can be firstly disposed on the casing 312, and then the casing 312 is incorporated with the frame 31*a* to configure the accommodating space 311*a*. Such that, it can simplify the manufacturing process, reduce the production cost and increase the producing efficiency of the air-extracting type heat dissipating apparatus 3*a*.

Figure 6:
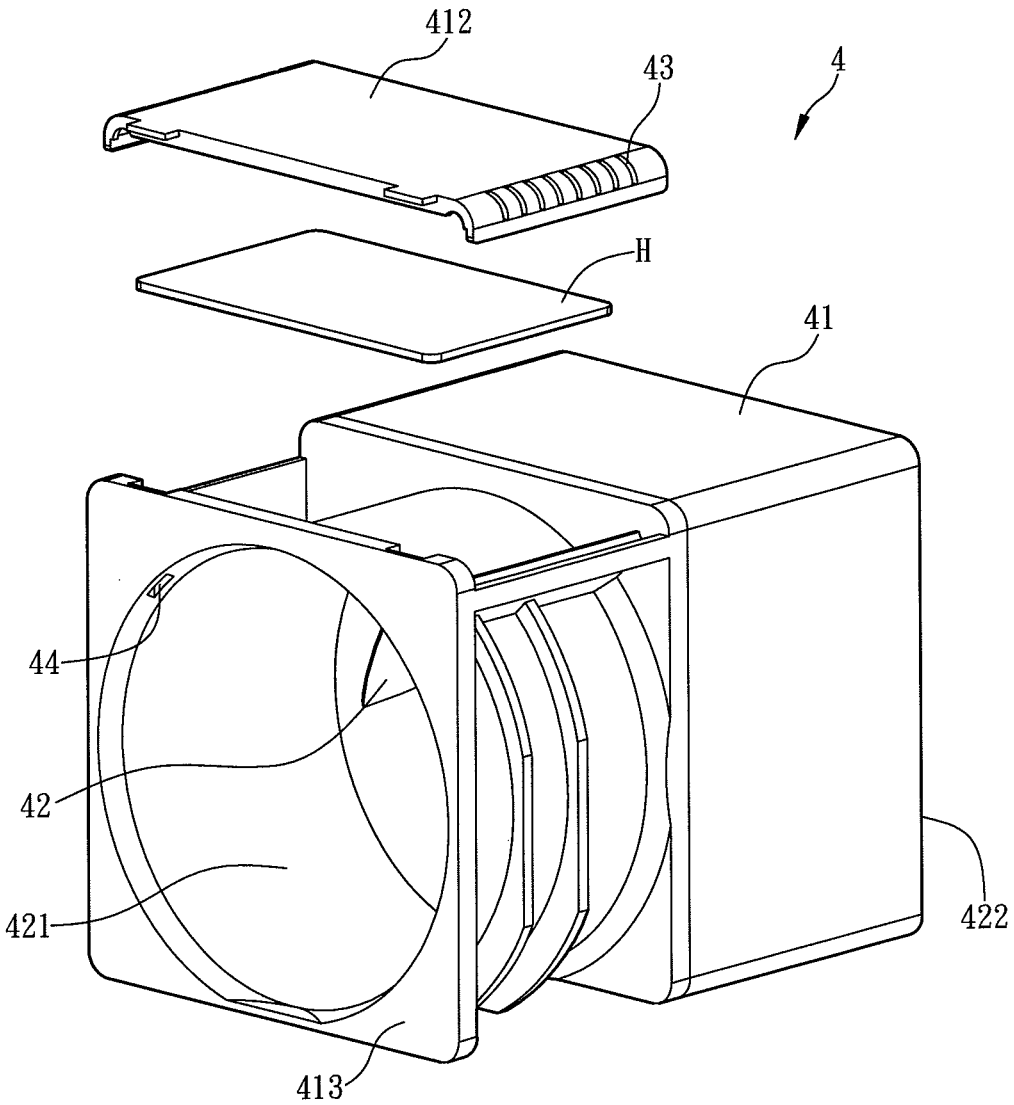

FIG. 6 shows an air-extracting type heat dissipating apparatus 4 of an aspect of the present invention. The difference between the air-extracting type heat dissipating apparatus 4 and the air-extracting type heat dissipating apparatuses of the embodiments as mentioned above is that the frame 41 further has an extended channel structure 413 located the first side 421, and the casing 412 is disposed on the extended channel structure 413 disposed on the side portion of the frame 41 to configure an accommodating space 411. And, the air-exhaling holes 44 can be disposed at the extended channel structure 413.

The extended channel structure 413 of the air-extracting type heat-dissipating apparatus 4 of the present embodiment can be used to form a difference pressure between the first side 421 and the second side 422 of the fan body 42, so as to further increase the volume of the inhaled air and effectively improve the efficiency of the heat dissipation.

Figure 7:
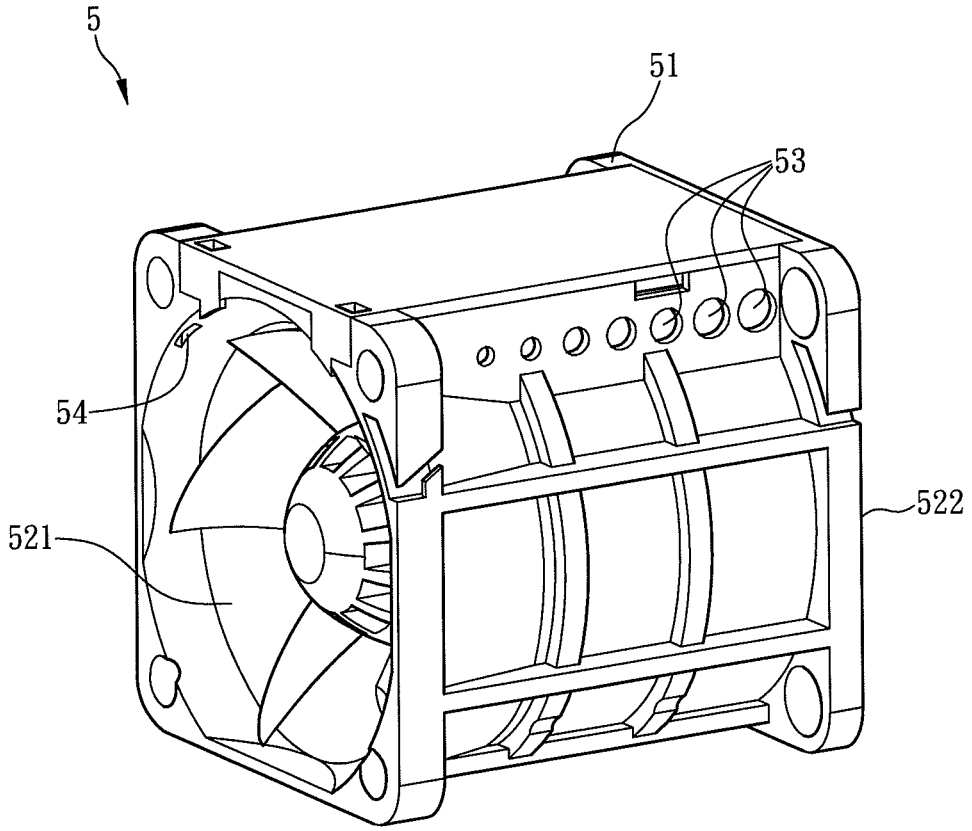

FIG. 7 shows an air-extracting type heat dissipating apparatus 5 of another aspect of the present invention. The difference between the air-extracting type heat dissipating apparatus 5 and the air-extracting type heat dissipating apparatuses of the embodiments as mentioned above is that the air-exhaling holes 53 disposed on the side portion of the frame 51 are arranged in sequence with increasing sizes. In this embodiment, the air-exhaling holes 53 are, for example, arranged in sequence with increasing sizes from the first side 521 to the second side 522. Generally speaking, because the air-inhaling holes 53 near the first side 521 are also close to the air-exhaling holes 54 disposed on the first side 521, they are easily influenced by the extracting effect occurred in the air-exhaling holes 54 and inhales relatively much more volume of air; conversely, because the air-inhaling holes 53 away from the first side 521 are far from the air-inhaling holes 53 disposed on the first side 521, they are less influenced by the extracting effect occurred in the air-exhaling holes 54 and inhales relatively small volume of air. However, the difference in the volume of inhaled air between them causes that the volume of air in the accommodating space is not uniform. To improve the air distributed evenly in the accommodating space, the air-exhaling holes 53 of this embodiment are arranged in sequence with increasing sizes from the first side 521 to the second side 522, such that the volume of air inhaled by each of the air-inhaling holes 53 is equal, so as to improve the efficiency of the heat dissipation. Of course, the air-inhaling holes 53 of the air-extracting type heat dissipating apparatus 5 of the present invention can be different aspects and disposed in the limited depositing space to improve the efficiency of the heat dissipation.

Figure 8:
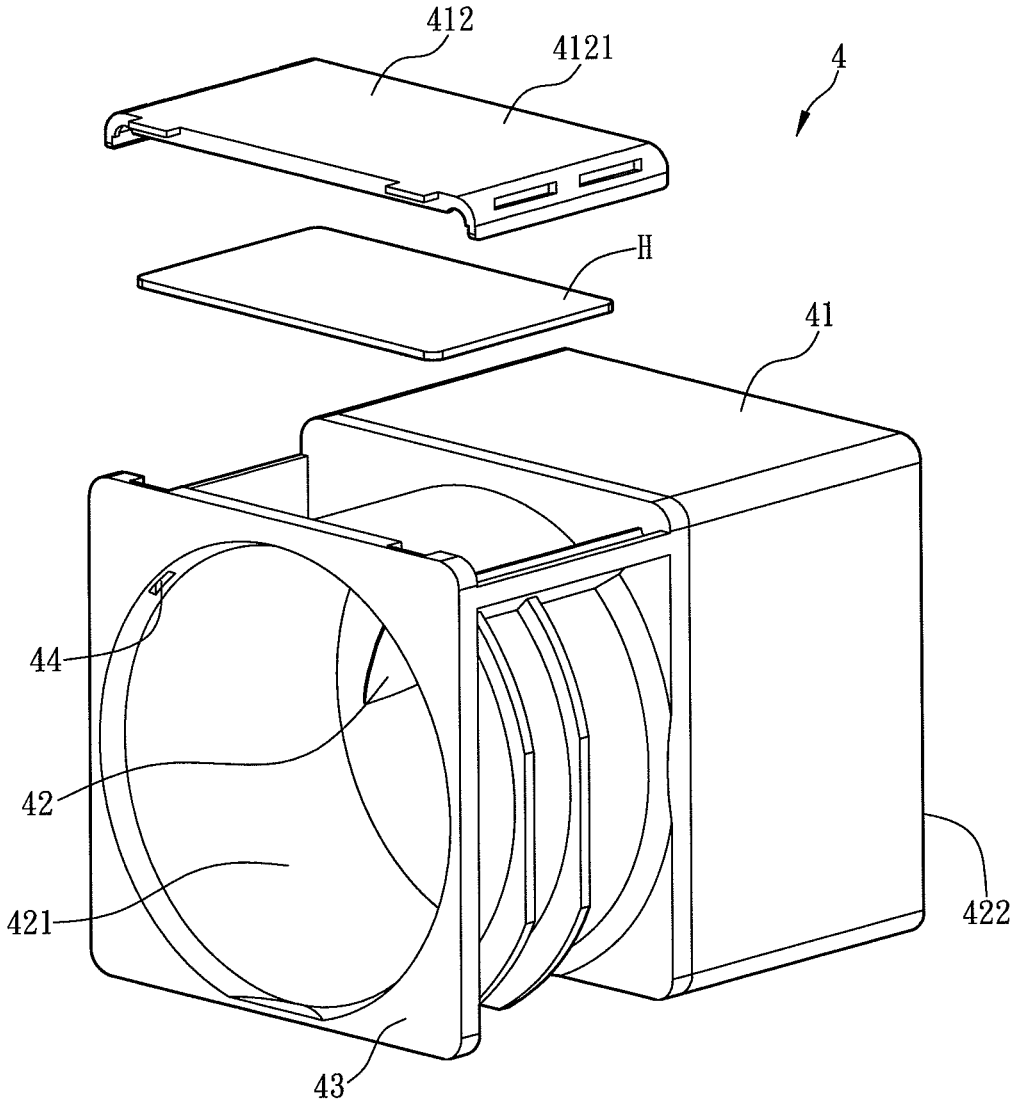
Figure 9:
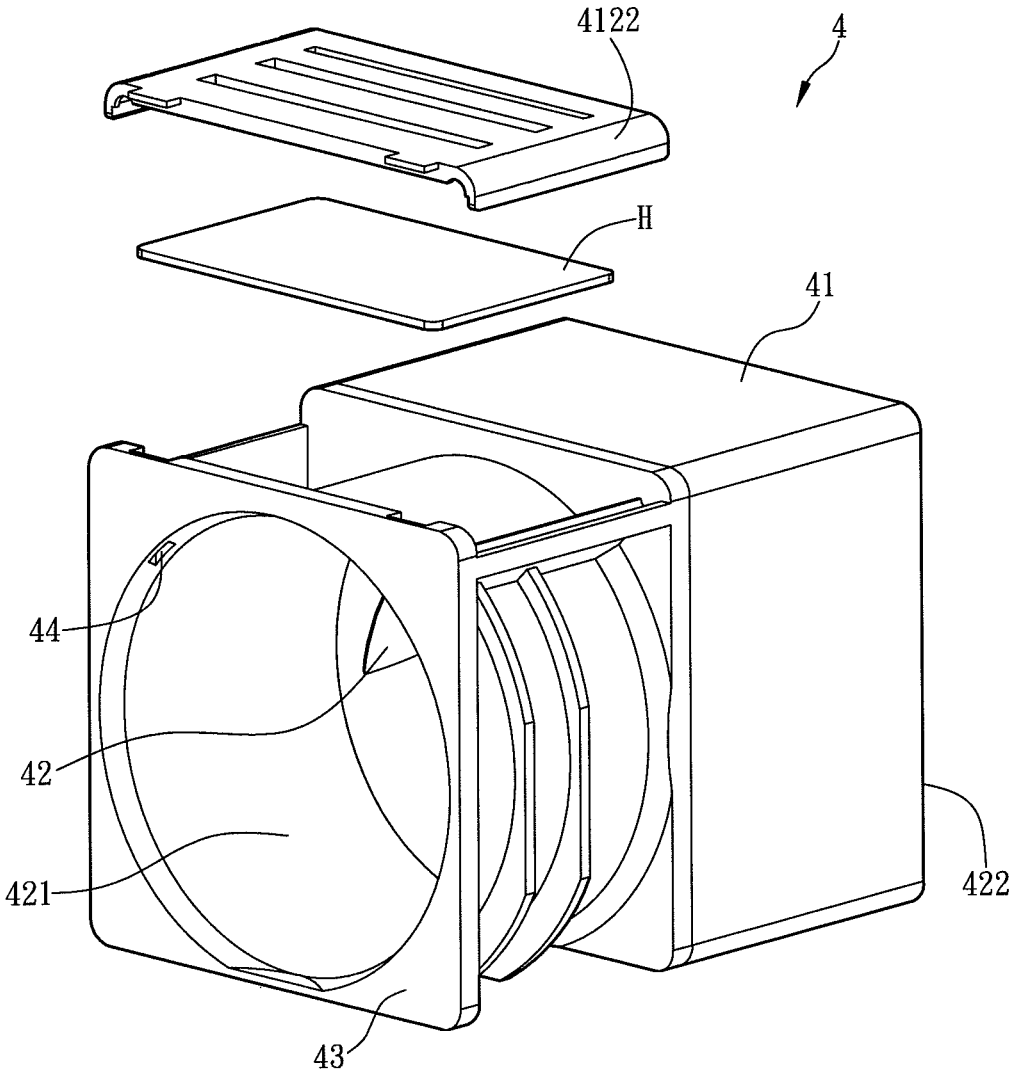

In one embodiment of the present invention, the casing comprises a base 4121 and two side walls 4122 extending opposite from the base. The air-inhaling holes are disposed on the base as shown in FIG. 8 or the side walls as shown in FIG. 9 The air-inhaling hole has a round or rectangular shape as shown in FIGS. 7-8.

It should be noted that, the air-inhaling holes 53 can be arranged in irregular form with different sizes for the purpose of increasing the volume of inhaled air and improving the efficiency of heat dissipation of the air-extracting type heat dissipating apparatus.

In summary, because a plurality of air-inhaling holes are disposed on the side portion of the frame configured with the accommodating space in the air-extracting type heat-dissipating apparatus of the present invention, and the air-exhaling holes are disposed on the frame and located on the first side (for example, the negative pressure side or air-inhaling side). Therefore, air flow enters the accommodating space from the air-inhaling holes by convection when the fan body runs, such that the heat source (such as the circuit board of the power supply apparatus) positioned in the accommodating space can be dissipated. Further, when the fan body runs, the pressure difference is formed between the first side and the second side (for example positive pressure side or air-exhaling side) and results in forming convection, and the air in the accommodating space is exhaled to the first side through the air-exhaling holes, and exhaled to the second side by the fan body, thereby further dissipating the heat generated by other electronic devices.

Hence, the air-extracting type heat dissipating apparatus in accordance with the present invention can dissipate the heat source inside by increasing the inhaled air volume through the air-inhaling holes disposed on the side of the frame, instead of diverting the inhaled air, such that the efficiency of heat dissipation is effectively improved.

Besides, because the openings in convention are disposed on the exhaling side of the apparatus to divert the air, it results in the problem of increasing noise level. However, since the air-exhaling holes of the present invention are disposed on the first side (air-inhaling side) and are not used to divert the air, it can not cause the problem.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. An air-extracting type heat dissipating apparatus, comprising:

a frame having one side portion configured with an accommodating space;

a fan body disposed in the frame and having a first side and a second side, wherein the first side is an air-inhaling side and the second side is an air-exhaling side;

a plurality of air-inhaling holes disposed on the side portion of the frame between the first side and the second side in corresponding to the accommodating space; and a plurality of air-exhaling holes disposed on the frame and located on the air-inhaling side;

wherein, an air in an environment is inhaled into the accommodating space through the air-inhaling holes, and exhaled to the first side through the air-exhaling holes, and then the air is exhaled to the second side by the fan body, and the air is exhaled into the environment through the second side, wherein none of the air-inhaling holes and the air-exhaling holes are located on the air-exhaling side.

2. The apparatus of claim 1, wherein a heat source is disposed in the accommodating space.

3. The apparatus of claim 1, wherein the frame has a casing disposed on the side portion of the frame to define the accommodating space.

4. The apparatus of claim 3, wherein the air-inhaling holes are disposed on the casing.

5. The apparatus of claim 4, wherein the air-inhaling holes are slit-shaped.

6. The apparatus of claim 1, wherein the air-inhaling holes are slit-shaped.

7. The apparatus of claim 1, wherein the frame further has an extended channel structure located at the first side.

8. The apparatus of claim 7, wherein the air-exhaling holes are disposed at the extended channel structure.

9. The apparatus of claim 1, wherein when the air-extracting type heat dissipating apparatus disposes horizontally and the second side is at the bottom, the height of the air-exhaling holes is greater than the height of the fan body.

10. The apparatus of claim 1, wherein the air-inhaling holes are arranged in sequence with increasing sizes.

11. The apparatus of claim 3, wherein the casing comprises a base and two side walls extending opposite from the base.

12. The apparatus of claim 11, wherein the air-inhaling holes are disposed on the base.

13. The apparatus of claim 11, wherein the air-inhaling holes are disposed on the side wall.

14. The apparatus of claim 1, wherein the air-inhaling hole has a round or rectangular shape.

* * * * *